US006939406B2

(12) United States Patent
Messina, Jr.

(10) Patent No.: US 6,939,406 B2
(45) Date of Patent: Sep. 6, 2005

(54) APPARATUS FOR CREATING UNIQUE RANDOM IMAGES

(76) Inventor: Joseph Leo Messina, Jr., 468 Ann St., Babylon, NY (US) 11702

( * ) Notice: Subject to any disclaimer, the term of this patent is extended or adjusted under 35 U.S.C. 154(b) by 0 days.

(21) Appl. No.: 10/622,911

(22) Filed: Jul. 18, 2003

(65) Prior Publication Data

US 2005/0011437 A1 Jan. 20, 2005

(51) Int. Cl.[7] ..... B05C 1/06
(52) U.S. Cl. ..... 118/264; 118/323; 427/429
(58) Field of Search ..... 118/264, 300, 118/323; 427/256, 429; 434/84

(56) References Cited

U.S. PATENT DOCUMENTS 3,021,227 A * 2/1962 Richardson ..... 427/287
4,067,111 A * 1/1978 Truitt ..... 33/27.11
4,199,868 A * 4/1980 Steward ..... 33/27.11
4,247,339 A * 1/1981 Bolton et al. ..... 106/468
4,928,625 A * 5/1990 Woods ..... 118/323

FOREIGN PATENT DOCUMENTS

| | | |
|---|---|---|
| DE | 355 014 C | 6/1922 |
| DE | 562 583 C | 10/1932 |
| DE | 873 225 C | 4/1953 |
| DE | 11 72 996 B | 6/1964 |
| DE | 21 00 128 B | 8/1972 |

* cited by examiner

*Primary Examiner*—Laura Edwards
(74) *Attorney, Agent, or Firm*—Thomas A. O'Rourke; Bodner & O'Rourke

(57) ABSTRACT

An apparatus for creating a random image is disclosed. The apparatus has a first support member with a hanging applicator member movably connected thereto. The hanging applicator is provided with at least one reservoir of material to be applied to a substrate. The reservoir has tubing extending from the reservoir for transporting the material to a brush. The brush provides a random pattern of material to a substrate in response to pressure from flowing air.

14 Claims, 6 Drawing Sheets

APPARATUS FOR CREATING UNIQUE RANDOM IMAGES

FIELD OF THE INVENTION

The present invention relates to an apparatus for use by artists and the like for creating unique one-of-a-kind type of works such as paintings and the like.

BACKGROUND OF THE INVENTION

Artists who draw work with a variety of media. There are oil paintings, water colors, pastels and others. Some artists use pen and ink, others use chalk, and still others use brushes. Other artists use non-traditional materials and these materials can be virtually anything that an artist deems appropriate.

One of the most common tools used by a painter is the brush. Paint is typically applied to the brush by dipping the brush into the medium and applying it to the selected surface. Using particular strokes, media and different brushes, different textures can be obtained. Traditionally, the brush is a length of material usually wood that is shaped such that it rests comfortably in the artist's hand. At one end of the brush are a plurality of bristles that are used to apply the paint to a surface. The bristles can be made of a natural or synthetic material. Nylon is one type of synthetic material that can be used in a brush. Other synthetic material can include polyesters, polyamides, polyolefins, etc. A natural material can be the hair of any number of mammals. Squirrel and pig bristles are two materials that are commonly used in brushes.

Artists are frequently seeking a variety of means of expressing themselves in a manner that is unique to themselves. One manner of expression is the type of brush stroke that is employed. When painting with a water color one type of brush stroke is typically employed. When oil paints are used another type of brush stroke can be used. Naturally, different variations of each type of stroke can be used to give texture and other features to the painting.

One concern of many painters is the uniqueness of their work. In addition, many artists are concerned that their works can be readily duplicated by third parties who can reproduce many works of art. Color photocopiers and other modern devices are so sophisticated that it has become very difficult for some people including some artists to discern whether a work is the original or a copy. For some types of works of art, mechanical copying is a real problem. This is less of an issue where the artist uses oil paints and similar media that creates a texture on the surface of the canvas or other surface.

When viewing a series of paintings done by an individual artist, a specific style will emerge. This style is specific to this artist, and is unique only to him or her. By analyzing the artist's brush technique, color palettes, etc., one may be able to generate a replica of an artwork. Thus, an artist's unique style is susceptible to imitation which can generate virtually identical copies of the artist's works. However, if the method of painting is completely random and no two works are the same, then the paintings are unable to be imitated. It has been found that there is a desire among some artists to produce a work that is unique to them and very difficult to reproduce effectively. As a result, there is an increasing amount of interest by painters for producing a work that can not be readily copied.

In addition to artists, patrons of the arts are also desirous of a work that is unique. These persons typically pay top amounts for an individual work or a work in a limited edition. The trust that the work is truly an original or that there work is truly a limited edition is fragile and the market for a work can be destroyed if there are unauthorized or even authorized copies of a work in general circulation.

One artist whose work is of particular interest with respect to the present invention is Jackson Pollock (1912–56) an important figure of the Abstract Expressionist movement. During the 1940's he was painting in a completely abstract manner, and the 'drip and splash' style for which he is known was developed in 1947. Instead of using the traditional easel he affixed his canvas to the floor or the wall and poured and dripped his paint from a can; instead of using brushes he manipulated it with 'sticks, trowels or knives' (to use his own words), sometimes obtaining a heavy impasto by an admixture of 'sand, broken glass or other foreign matter'. Pollock's name is also associated with the introduction of the All-over style of painting which avoids any points of emphasis or identifiable parts within the whole canvas and therefore abandons the traditional idea of composition in terms of relations among parts. The design of his painting had no relation to the shape or size of the canvas—indeed in the finished work the canvas was sometimes docked or trimmed to suit the image. Using the apparatus of the present invention it is possible to create paintings that may have some of the attributes of this style of painting popularized by Pollock.

OBJECTS OF THE INVENTION

It is an object of the present invention to provide a device that utilizes the power of the wind to move a brush across a canvas or other surface.

It is another object of the present invention to provide a device that utilize the power and randomness of the wind to manipulate a brush across a canvas to make paint or sketch strokes on the surface of the canvas or other surface.

It is also object of the present invention to provide a device that utilizes the power and randomness of the wind to create unique works such as paintings or sketches It is a further object of the present invention to provide a device is easy to set-up and works in any location where wind is present.

It is a still further object of the invention to provide an apparatus that creates unique one of a kind works of art.

It is another object of the invention to employ the rotation of the earth to move a brush over a canvas.

SUMMARY OF THE INVENTION

The wind is a powerful force, which flows in generally a random manner. At a given location the force provided by the wind is not always continuous but rather frequently irregular. The present invention uses the wind to provide a driving force to move a paintbrush across a canvas. Since the wind motion is not always in the same direction or with the same force, the wind can be used to produce a sketch or a painting that is unique. The very nature of the painting so created renders it also difficult to copy. The present invention has a stand that supports an implement that may be any suitable drawing device such as a brush, a pen or other device. The implement extends from an upper portion of the stand and is positioned on a string, rope, wire or other suitable material that permits the implement to move at least for a portion of its travel over a canvas or other substrate. In a preferred embodiment the implement is in the form of a pendulum as it travels over at least a portion of its path of travel. Where the implement is traveling in a motion that is like a pendulum, the canvas or other substrate can be curved to receive the strokes of the implement as it is moved. In this manner, each painting or picture created by utilizing the force of the wind will generate a work that is unique to that day, time, weather, etc. And, even if another person were to generate another painting in the same manner, on the same day, at the same time, in the same vicinity as the original was created, the wind pattern would not be the same. Thus, there would be noticeable differences between the two works.

Where paint is to be used on the work there may be one or more reservoirs on the device from supplying paint to the end of the brush. Preferably the device has three such reservoirs. These reservoirs can dispense any color selected by the artist. In the preferred embodiment, the handle of the brush, stylus or other implement is hollow to permit the flow paint to the bristles of the brush. In a preferred embodiment, the brush mechanism is in the form of a tubular member that has a plurality of bristles extending from at least one end of the tubing. The other end of the tubing is connected to the flexible tubing that carries the paint from a paint reservoir to the brush apparatus.

In one embodiment the stand has one or more legs for supporting the device. Supported by the legs may be a generally horizontal member from which a implement is hung. As the writing implement is buffeted by the wind intricate and unique designs are created on a canvas. The uniqueness of the art work so created is further enhanced by anything that is also blown onto the canvas or other substrate by the wind. Thus, for example, if the device is set up at a beach the wind can also blow sand onto the substrate since the amount and placement will vary with the direction and force of the wind each drawing will have a texture that is different from other drawings.

In a still further embodiment of the invention the substrate to be painted can be in an enclosed room where the wind is not present and the brush can be provided with the same motion as a pendulum. If the length of the pendulum is rather long the back and forth motion of the brush can, over a twenty-four hour period cover an entire portion of the substrate not unlike the movement of a Foucault pendulum as it knocks over a circular arrangement of pegs as the pendulum moves back and forth over a twenty-four hour or other period.

BRIEF DESCRIPTION OF THE DRAWINGS

FIG. 2 is an end view of an example of a table having a flat surface for mounting a substrate to be worked on.

FIG. 5 is a side view of an alternate example of a table for mounting a substrate to be worked on.

DETAILED DESCRIPTION OF INVENTION

Figure 1:
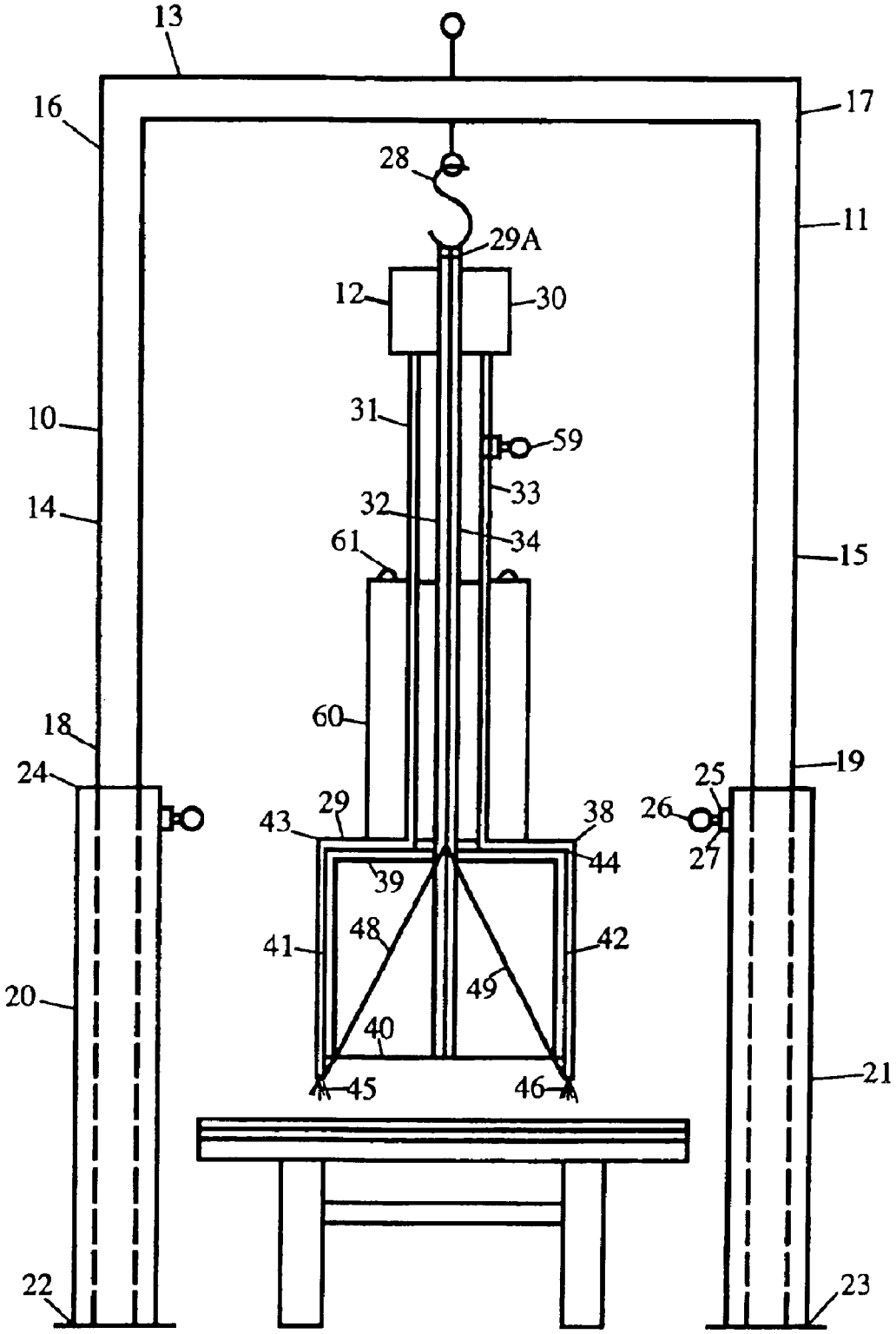
FIG. 1 is a side view of a preferred embodiment of the apparatus of the present invention.

The apparatus 10 of the present invention has a frame 11 from which an applicator mechanism 12 is suspended. The frame may have a generally horizontal member 13 from which one or more generally vertical members 14 and 15 extend. Since the device i subjected to the wind in most instances, a sturdy framework is preferred. The vertical members 14 and 15 have a first end 16 and 17 adjacent to the horizontal member 13. The opposite ends 18 and 19 of the vertical members may be inserted directly into a support surface such as the ground or they may be provided with a flat base portion (not shown) for resting on a surface such as the ground. The vertical members may alternatively be inserted into two anchor legs 20 and 21. Each anchor leg may be set into the ground at one end 22 and 23 and open at the other end 24 and 25 for receiving the vertical members. The bottom of the anchor leg 20 and 21 can be dug into the ground or weighted at the surface of the ground as desired. The top end of each anchor leg 24 and 25 is open to allow the vertical members 14 and 15 of the frame to be inserted. Each anchor leg may also be provided with a screw 26 laterally inserted into an orifice 27 in the anchor for securing the vertical members 14 and 15 at the desired height. In one embodiment, the vertical members 14 and 15 are provided with a plurality of orifices 27 along their length for receiving the screw 26. The plurality of orifices are to secure the vertical members at different heights above the work surface or accommodate different height work surfaces. In another embodiment, when turned, the screw 26 articulates with the frame, and allows for the frame height to be changed. The screw may be replaced by a gear-locking mechanism that will allow the user to push the frame higher and release when the frame is to be lowered.

The frame and anchor leg set-up described above may be replaced by any framing means sufficient to provide support for the device and the necessary height needed for its operation. A-frame type structures may also be used. In the A-frame structure, there are two generally vertical members positioned on each side of the frame. These vertical member join or meet in the vicinity of the horizontal member Extending downwardly from a member, such as the horizontal member 13 is a connection means 28 for hanging the applicator support 29A. The connection means 28 is preferably positioned generally in the center of the length of the horizontal member. The connection means may be a ring, or another attachment device that will hold the hanging applicator support 29A. As shown in FIG. 1 the connection means may be for example a "S" hook. In another embodiment the connection means may be rotatable to permit the apparatus to rotate.

It will be appreciated that the connection means 28 does not have to be in the center of the horizontal member. Also, there need not be a connection means if the hanging applicator member 29 is provided with a rope or cable that may be tied or fastened to the horizontal member 13. In the embodiment shown in FIG. 1, The connection means 28 has a chain or cable 29A attached thereto as the applicator support.

The hanging applicator member 29 preferably has support member 34 of a variable length to be adjusted by the user depending on the height of the frame and the placement of the work surface. Suitable materials for the support member can be a chain, cable rope or other suitable material. The hanging applicator member 29 is provided with one or more reservoirs 30 for storing the paint, ink or other material to be applied to a substrate. Extending from each of the reservoirs are lengths of tubing, preferably hollow. As seen in FIG. 1 there are three lengths of tubing 31, 32, 33 for each of three reservoirs. In one embodiment, one or more of the tubes may be provided with a valve means 59 to adjust the flow of paint through the tubes.

The lengths of tubing may be supported by a frame 38. The frame 38 is preferably a wire frame and may have a first horizontal member 39 and a second horizontal member 40. The first and second horizontal members are joined by first and second vertical members 41 and 42. Extending from the junctions 43 and 44 where the second horizontal member 40 connects to the first and second vertical members 41 and 42 respectively, there are preferably a pair of brush members 45 and 46 extending downwardly. Although shown two dimensionally in the Figures, the frame may have three dimensions depending on the number of brushes and the locations chosen for their placement. For example, the frame may be in the form of a generally horizontal triangle with a brush at each corner. Alternatively, the frame may a rectangle or other quadrilateral and have four corners or even other shapes. It is not suggested however, that the number of brushes requires any fixed shape for the frame. For example the frame may only be two dimensioned as seen in FIG. 1 and have additional brushes positioned along second horizontal member 40 at different locations.

The frame may also be rotatable about the support means such as a cable. This permits the brushes to have imparted thereto a rotational motion in addition to the back and forth motion of a pendulum. The wire frame may also have one or more diagonal members 48 and 49 to provide additional support to the frame.

Each of the applicator tubes ends in a brush mechanism. Where there are there three reservoirs of material there will be three brushes present. It may be desired to increase the ability of the wind to power the device. Accordingly, a sail or wind catcher 60 may be present. The sail may be a 0.040 gauge sheet of aluminum or other material. The sail maybe any size or shape desired depending on the wind. The sheet may be secured to the cable, chain or string by ties 61.

The hanging applicator member 29 moves in response to the force of the wind. For example, in one instance, the applicator member 29 may move like a pendulum's motion between the vertical members of the frame. In other instances, the motion may be completely random. As the hanging applicator member moves, the brushes apply the desired material to the substrate in a random pattern. If the surface of the substrate is considered a plane having X and Y axes, each axes can have a length $X_1$, $X_2$ and $Y_1$ and $Y_2$. Depending on the force of the wind, the length of time the device is operating and the viscosity of the material being applied the brushes can apply the material in a random manner over the surface of the substrate.

Figure 2:
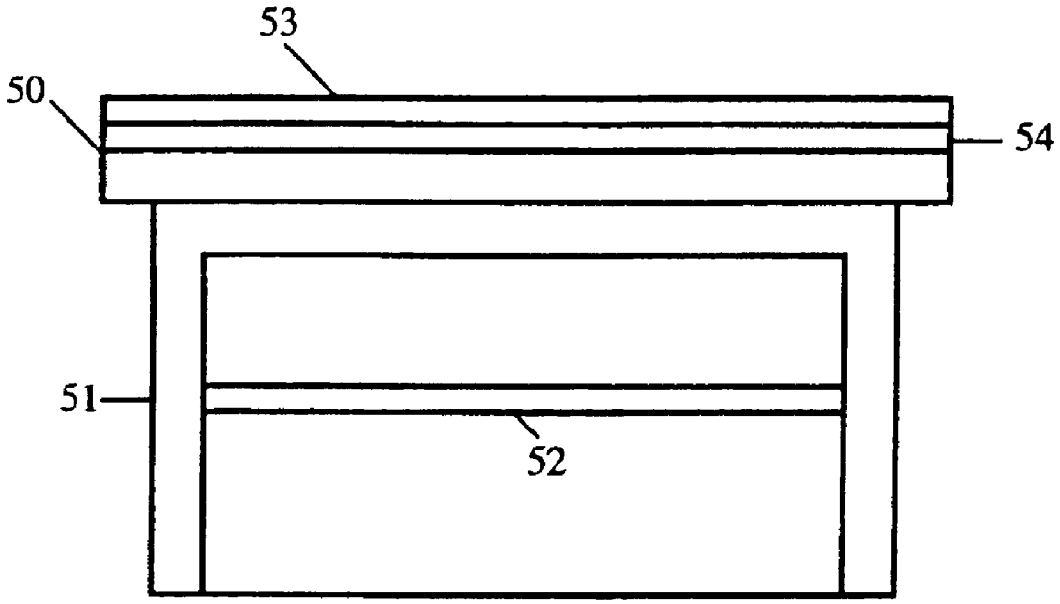

In an alternative embodiment, the reservoirs can be positioned any where along the length of the applicator member and can be in the form of container. In one embodiment, the containers can be inverted and inserted into an orifice in a bushing that retains them in position. Valve means can be used to control the flow of the material from the reservoirs. The frame for supporting the brushes may be any shape desired. Although a wire frame is shown, other designs are feasible as long as they are relatively light in weight and can be readily moved by the wind or the motion of a pendulum. In an alternative embodiment, the frame holding the brushes can rotate thereby causing the brushes to have additional motion over and above the back and forth motion usually caused by the wind As shown in FIG. 1 and FIG. 2, the substrate may be positioned so that it rests on a table 50 or other flat support surface. The support surface for the substrate may be any suitable means. FIGS. 1 and 2 show a base, support or table 50 having a plurality of legs 51. Brace 52 may extend from one or more of the legs to another leg to provide additional strength to the support. The substrate 53 may rest on the upper surface of the support or it may be placed on another suitable surface such as a foamed surface 54. The foamed surface provides a softer surface for the brushes to operate on. In one embodiment, the substrate may be placed on a foamed material which in turn may be paced on a sheet of plastic material 55 such as Lexan. The foamed material absorbs the blows from the wind.

Figure 3:
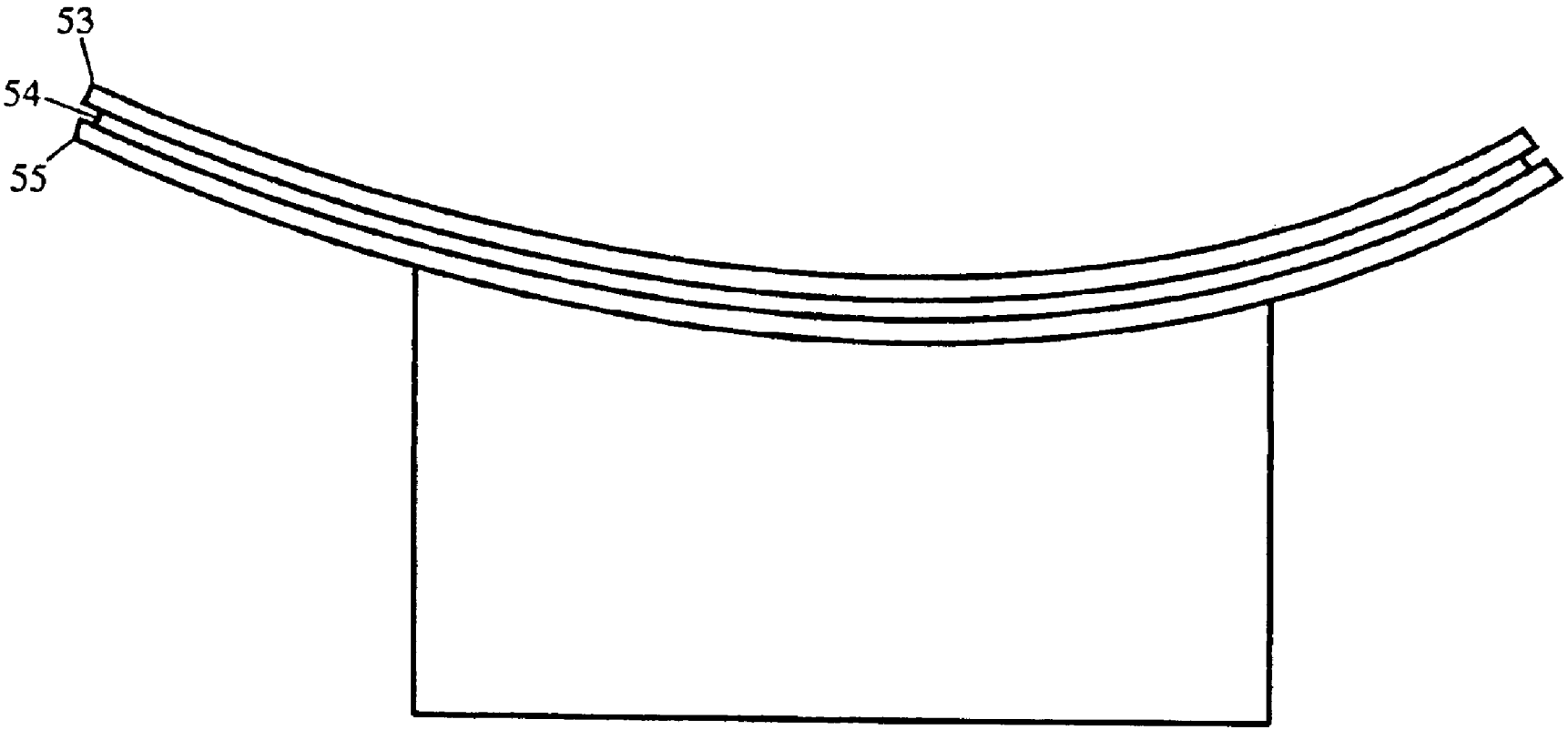
FIG. 3 is a side view of an example of another type of table for use with the apparatus of FIG. 1.

FIG. 3 shows an alternate embodiment of the support of the present invention. In this support there is a curved surface on which the substrate is positioned. The curved surface preferably has the same or similar arc as the motion of the hanging applicator member 29. In this arrangement, the hanging applicator member covers more of the surface of the substrate than when the substrate lies flat. In other words, a larger substrate may be covered with material when placed in the shape of an arc than when the substrate lies flat. The arc may be provided by a plastic member 55 that is cut and trimmed to mirror the travel of the hanging applicator member 29.

Figure 4:
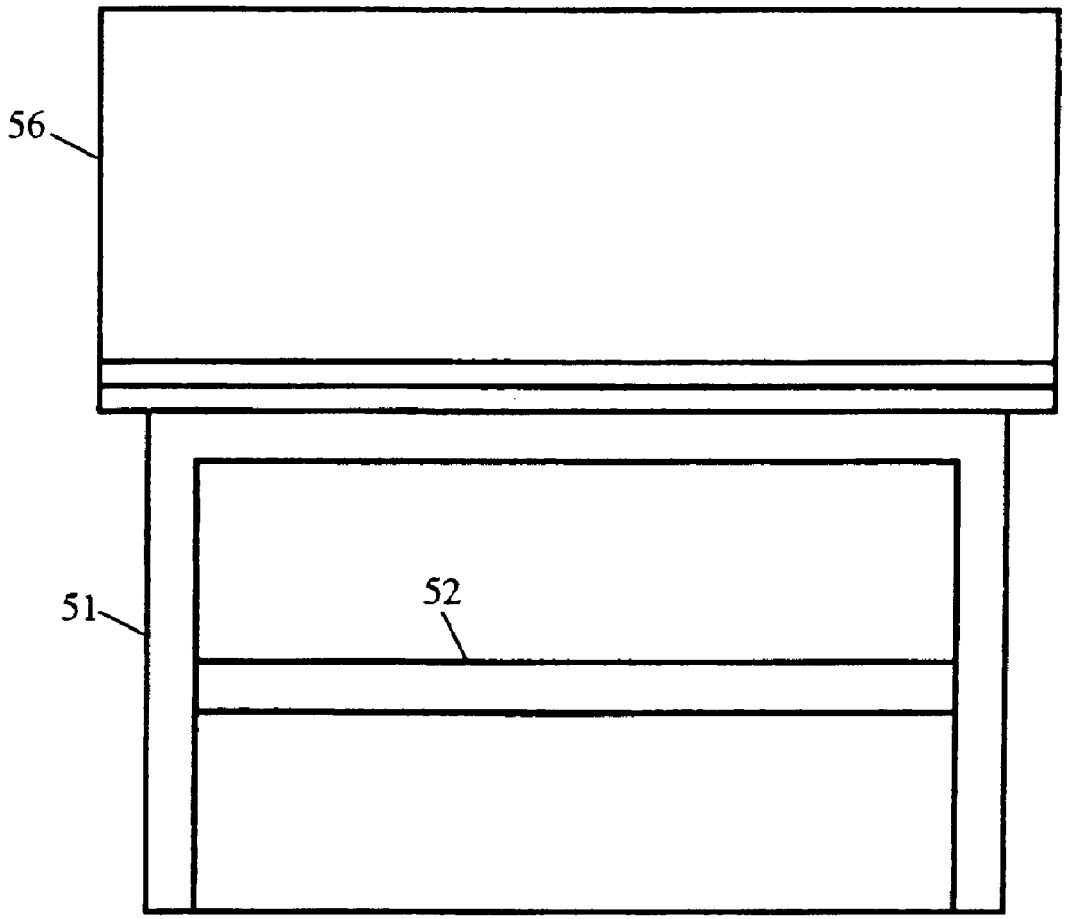
FIG. 4 is an end view of the table of FIG. 3.

FIG. 4 shows a side view of the support of FIG. 3. In this Figure, the substrate rests on the upper surface of the support or other material thereon. Depending on the amount and how continuous is the force supplied by the wind, a support of the type shown in FIG. 5 may be used. In this Figure the support 50 for the substrate is provided with a first height 56 and a second height 57 and the first height 56 is greater than the second height 57. The upper surface of the support is provided with a curved surface. The arc of the article shown in FIG. 4 is approximately one-half the arc of FIG. 3.

Figure 5:
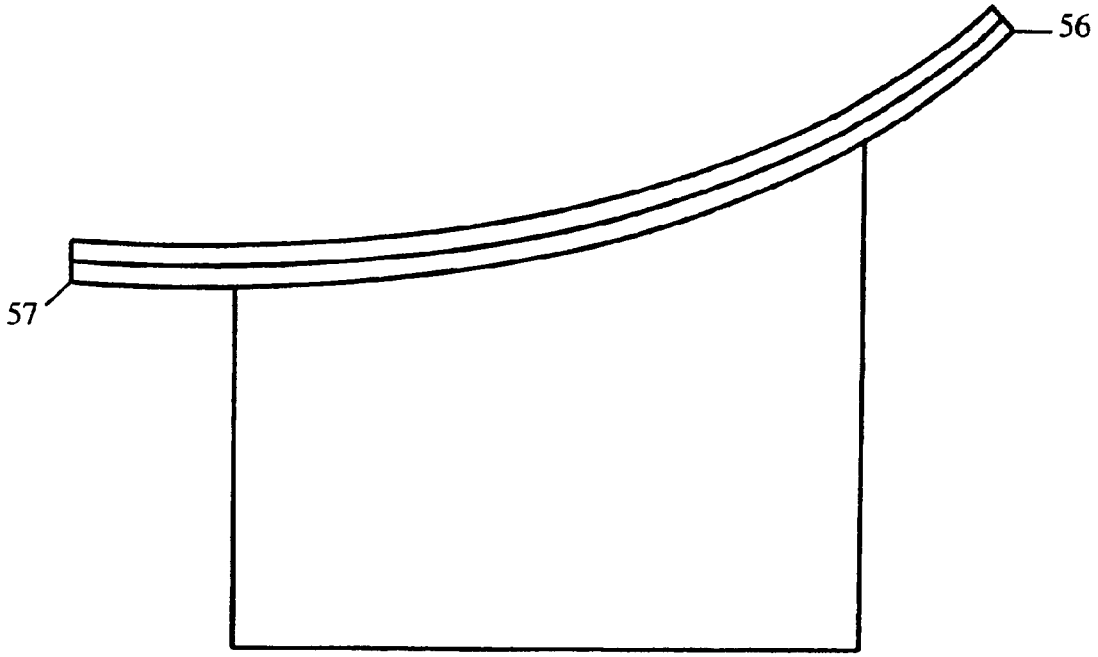

FIG. 5 shows the preferred brush of the present invention. This brush has a tubular member 70 having a first end 71 and a second end 72. Extending from the first end 71 are a plurality of bristles 73. In lieu of bristles, a porous foamed material can be used to apply the paint of other material. In its motion powered by the wind, the brush device will articulate with a canvas or other substrate on a flat or curved palate member. The palate member or base 50 is preferably centered between the anchor legs of the device and underneath the brush portion of the hanging applicator member. In this embodiment, the top surface of the palate member is generally concave, and a substrate such as paper, canvas or a plastic sheet is placed on top of it. The concave surface of the palate member is supported by a rectangular framework. The framework, in one embodiment, is composed of two pieces of wood on its longer sides and two metal stabilizing strips on its shorter sides. Each wood side has a flat bottom side and a concave upper side. Each metal stabilizing strip connects the two wood pieces. The framework positions the concave surface a small distance off the ground. Also, the framework has an attachment means on one of its members. This attachment means holds an anchor member. The anchor member, which may be a weight or fixed to the ground, holds the palate member in a static position.

Figure 6:
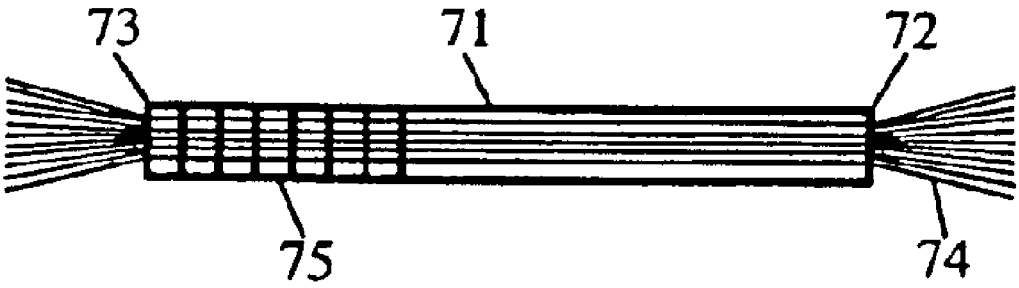
FIG. 6 is a side view of a brush that is suitable for use with the present invention

One of the features of the present invention is the brush. FIG. 6 shows a preferred brush that may be used with the present invention. The brush is made up of a hollow tube portion 71. The hollow tube portion 71 has a first end 72 and a second end 73; The first end is removably connected to the end of the tubing that transports the paint. The connection may be made by inserting the bristles into the open end of the tubular member 31 and securing the two togther by any suitable means such as by tape or other easily removable means so that the tubing may be cleaned. Extending from first end of the hollow tube member are bristles, preferably synthetic bristles 73 that are of the type typically used for latex type paints. These bristles extend into the orifice at the end of the tubing and provide a pathway for the paint to flow into the brush. The bristles transfer paint down the tube into the hollow tube member where it is picked up by the bristles 74 extending from the second end 72 of the hollow tube member. In a preferred embodiment, the bristles my be placed around at least a portion of the exterior surface of the tip or end portion of the tube. These bristles may be either natural bristles if an oil based type paint is used or synthetic brushes if a water based paint is used. Nylon is one type of synthetic material that can be used in the present invention. Other synthetic materials can include polyesters, polyamides, polyolefins, etc. A natural material can be the hair of any number of mammals. Squirrel and pig bristles are two materials that are commonly used in brushes.

The bristles are preferably secured to the outside of the tubes by first applying a layer of flymaker's wax to the second end 72 of the hollow tube. Around the waxed end is wrapped a binding. A cement glue is placed on the binding. The bristles are dipped into a cement glue and placed around the tube. The exterior surface of the bristles where they are positioned on the end of the hollow tube are covered with a varnish and wrapped with a French Tinsel 75.

I claim:

1. An apparatus for creating an image comprising a first support member having a hanging applicator member movably connected thereto, said hanging applicator being provided with two or more reservoirs of material to be applied to a substrate, each of said reservoirs having a delivery means extending therefrom for transporting said material to a brush means, each of said brush means providing a random pattern of material to said substrate in response to pressure from flowing air, each of said delivery means comprising a length of tubing being supported by a frame, each length of tubing ending in said brush means and wherein each brush means is separated from any other brush means.

2. The apparatus according to claim 1 wherein each brush means comprises a hollow tubular member having a first end and a second end, said first end receiving said material from said delivery means and said second end having plurality of bristles in said tubular member for applying said material to said substrate.

3. The apparatus according to claim 1 further comprising a base, said base having a substrate thereon for receiving said image.

4. The apparatus according to claim 3 wherein the substrate is on a base having a flat upper surface.

5. The apparatus according to claim 3 wherein the substrate is comprised of a flexible material.

6. The apparatus according to claim 4 wherein said base has an upper surface that is concave and said substrate conforms to the shape of the upper surface of said base.

7. An apparatus for creating an image comprising a first support member having a suspended applicator member movably connected thereto, said suspended applicator having a wind catcher attached thereto for receiving breezes of wind that power said applicator, said suspended applicator further provided with at least one reservoir of material to be applied to a substrate, said reservoir having a delivery means extending therefrom for transporting said material to a brush means, said brush means providing a random pattern of material to said substrate in response to pressure from flowing air on said wind catcher.

8. The apparatus according to claim 7 wherein the material is paint.

9. The apparatus according to claim 7 wherein the material is ink.

10. The apparatus according to claim 7 wherein the material is pastel.

11. The apparatus according to claim 7 wherein the first support member is a horizontal member being supported by at least one vertical member.

12. The apparatus according to claim 7 wherein the random pattern of material created in response to flowing air is different from every other random pattern so created.

13. An apparatus for creating an image comprising a first support member having a hanging applicator member movably connected thereto, said hanging applicator being provided with at least one reservoir of material to be applied to a substrate, said reservoir having a delivery means extending therefrom for transporting said material to a brush means, said brush means providing a random pattern of material to said substrate in response to pressure from flowing air and wherein said first support member is a horizontal member being supported by at least one vertical member and, wherein there is an anchor leg having a first end and a second end, said first end being adapted to rest on a support surface and the second end having an opening for receiving a vertical member.

14. The apparatus according to claim 13 wherein an anchor leg is provided with a screw laterally inserted into an orifice in the anchor leg for securing a vertical member at a desired height.

* * * * *